United States Patent [19]

Toramoto

[11] Patent Number: 5,061,205

[45] Date of Patent: Oct. 29, 1991

[54] ELECTRICAL CONNECTOR FOR FLAT ARRANGED TERMINALS

[75] Inventor: Hisao Toramoto, Soraku, Japan

[73] Assignee: Hosiden Electronics Co., Ltd., Yao, Japan

[21] Appl. No.: 538,623

[22] Filed: Jun. 15, 1990

[30] Foreign Application Priority Data

Jul. 10, 1989 [JP] Japan ..... 1-81415[U]

[51] Int. Cl.[5] ..... H01R 9/07

[52] U.S. Cl. ..... 439/493; 439/789

[58] Field of Search ..... 439/492–499, 439/792, 790, 796, 789

[56] References Cited

U.S. PATENT DOCUMENTS

| | | | |
|---|---|---|---|
| 4,027,941 | 6/1977 | Narozny | 439/497 |
| 4,253,719 | 3/1981 | McGinley | 439/345 |
| 4,936,792 | 6/1990 | Onoue et al. | 439/493 |
| 4,944,490 | 7/1990 | Imai | 439/492 |

*Primary Examiner*—Larry I. Schwartz
*Assistant Examiner*—Hien P. Vu
*Attorney, Agent, or Firm*—Armstrong, Nikaido, Marmelstein, Kubovcik & Murray

[57] ABSTRACT

An electrical connector for flat arranged terminals provided on a flexible sheet is more compact in size and reduces the number of parts via one-piece formation. A body portion and a cover portion of the connector are configured by insert molding to contain a frame having parallel conductive contact lines as an insert. The body is configured to be spaced from the cover, but connected by a pair of hinge portions. The contact lines extending from two sides of the body are cut off from the prior stage frame, and the lines extending from one side are each bent on the body to form a leaf spring. The lines extending from another side of the body are curtailed. Then, the cover is bent over the body to fit each other. In the fitting, the cover is withheld first at a position that provides a clearance to receive the flexible sheet having terminals to be connected. After inserted of the flexible sheet in place, the cover is pressed on the body to hold the flexible sheet firmly, and thereby accomplish internal line contacts.

3 Claims, 5 Drawing Sheets

ELECTRICAL CONNECTOR FOR FLAT ARRANGED TERMINALS

FIELD OF THE INVENTION

This invention relates to an electrical connector for connecting terminals. More particularly, this invention relates to an electrical connector for extending terminals which are arranged flat or in parallel on a flexible sheet, for instance, flexible board for printed circuits, flat cable.

DESCRIPTION OF THE CONVENTIONAL ART

A connector in the pertinent art has been composed of a connector body which provides contacts for lines extending to a next device outside, and of a cover which holds a flexible printed sheet, for instance, so that terminals printed on the sheet will be held in contact with the contacts provided inside the connector body. Therein, normally the sheet is inserted into the cover and then the cover is fitted with the body.

In the conventional art described, at least three independent parts; connector body, contacts, and cover, have been involved in addition to the flexible sheet which contains flat arranged terminals. This requirement has been against the desire of leading assemblage of components to be reduced in the number of parts involved and to render the connector more compact in size. Further therein the difficulty of carrying out manually something like the artisan' skill has been included to obtain adequate contacts between the flexible sheet and the contacts provided in the body.

SUMMARY OF THE INVENTION

This invention is offered to overcome the disadvantages as noted in the conventional art and summarized as follows:

First, a connector body and a cover are one-piece molded with a space but in connection each other including parallel conductive lines which will act later as electrical leads through the connector. Then, the cover is turned over to fit with the body, and a clearance formed between the cover at a first turned position and the body is utilized for a flexible sheet having terminals to be connected to enter thereinto. The cover is pressed further onto the body with the flexible sheet held inbetween. Thereby these partaking components are brought into integration as a connector. More comprehensive descriptions to support the subject matter of the present invention will be given in the following with reference to the appended drawings.

BRIEF DESCRIPTION OF THE DRAWINGS

A like reference numeral indicates a like part through the drawings. These drawings are presented by way of illustrating the invention. Therefore these drawings should not be construed as limiting the invention.

DESCRIPTION OF THE EMBODIMENT(S)

Figure 1A:
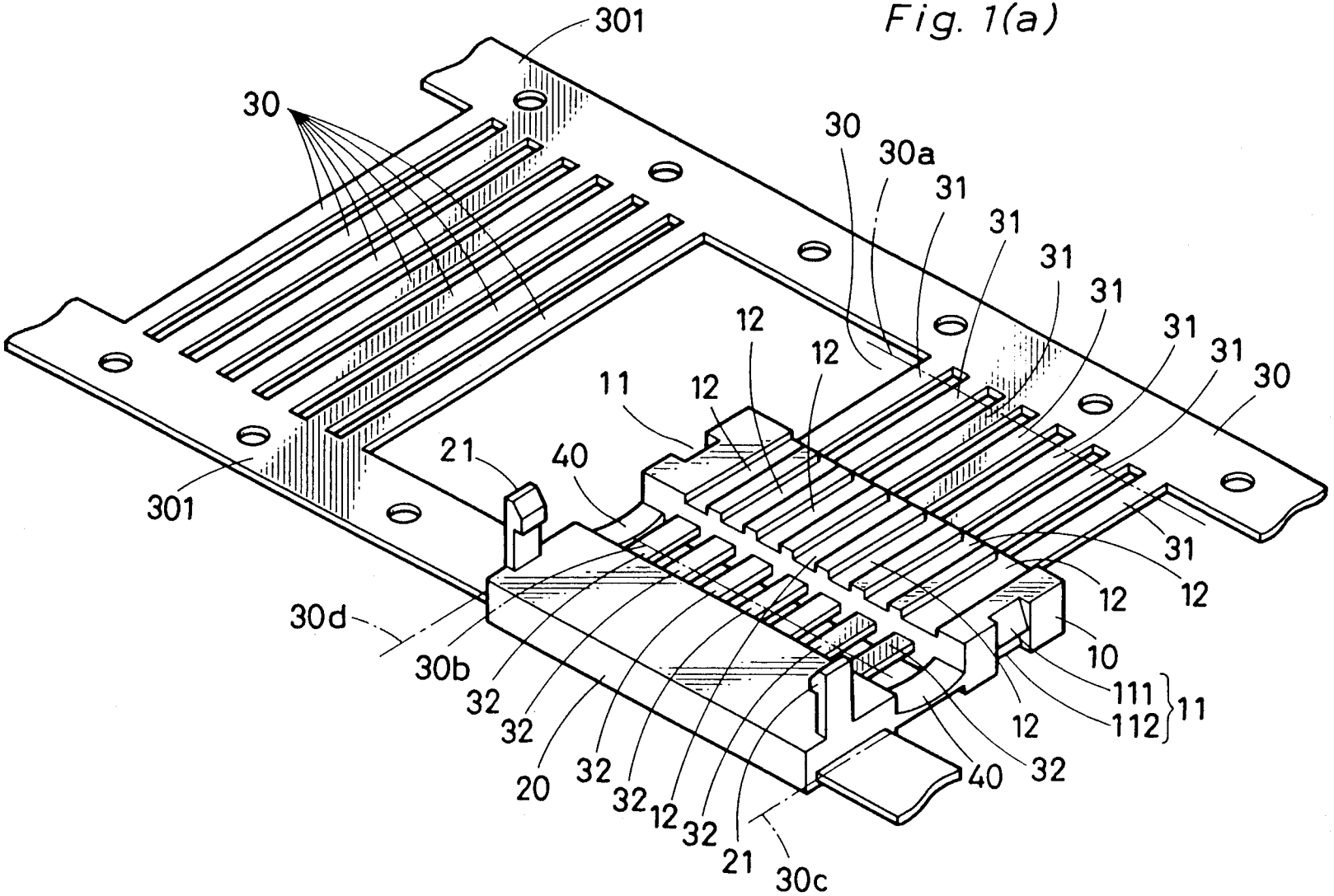
FIG. 1 including four sub-drawings FIG. 1 (*a*) through (*d*) shows, in perspective view, a process of manufacturing a connector of the present invention.
Figure 1B:
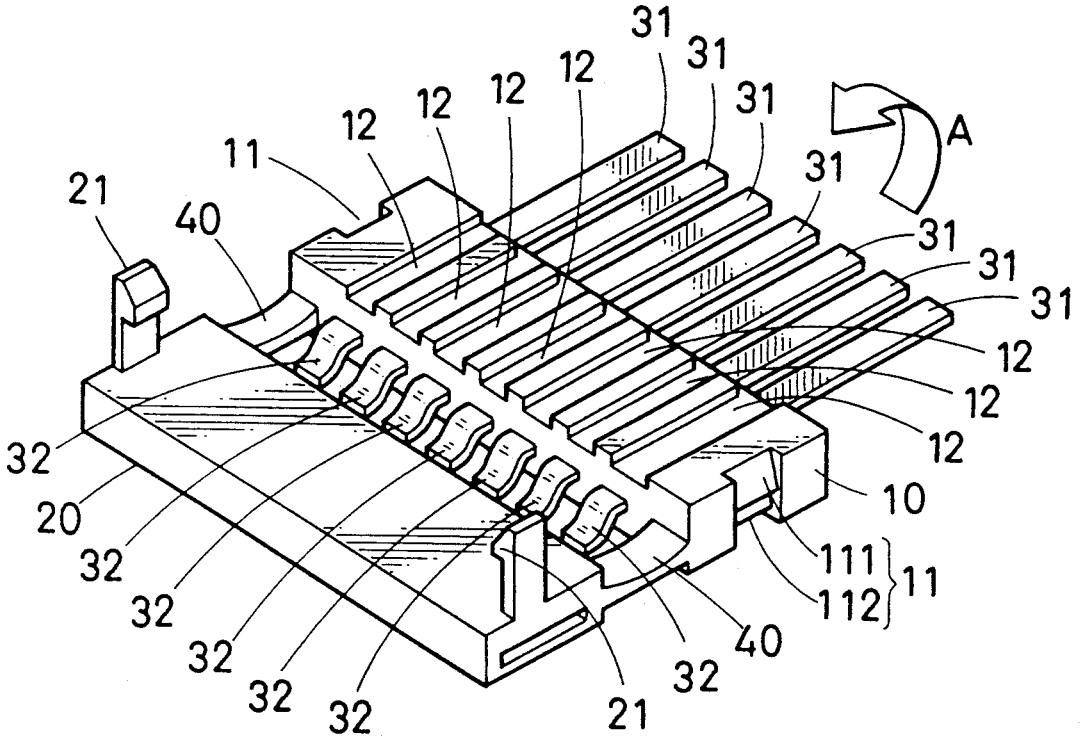
Figure 1C:
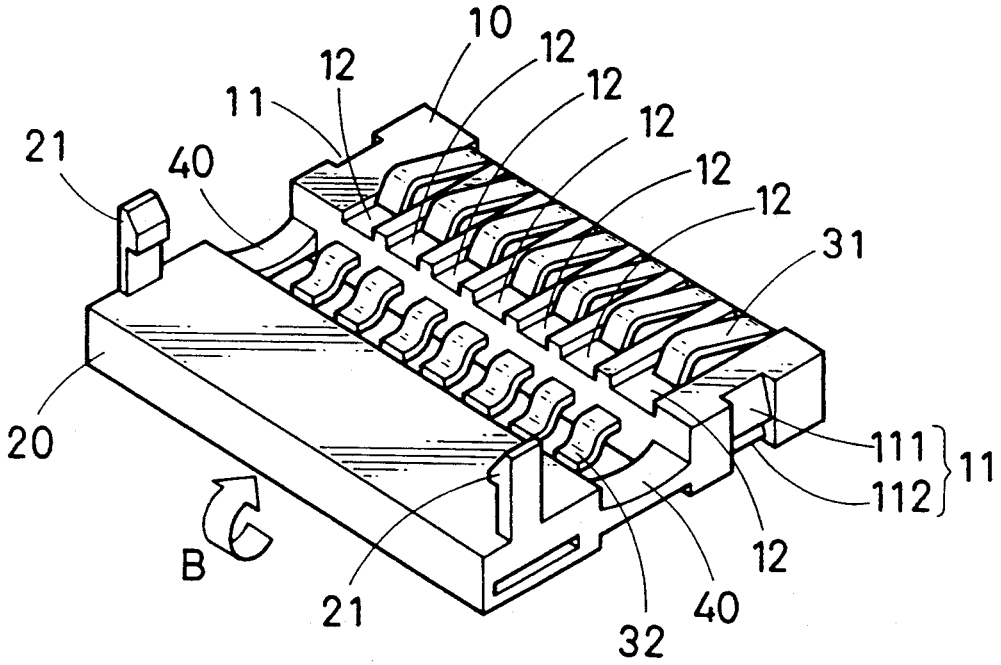
Figure 1D:
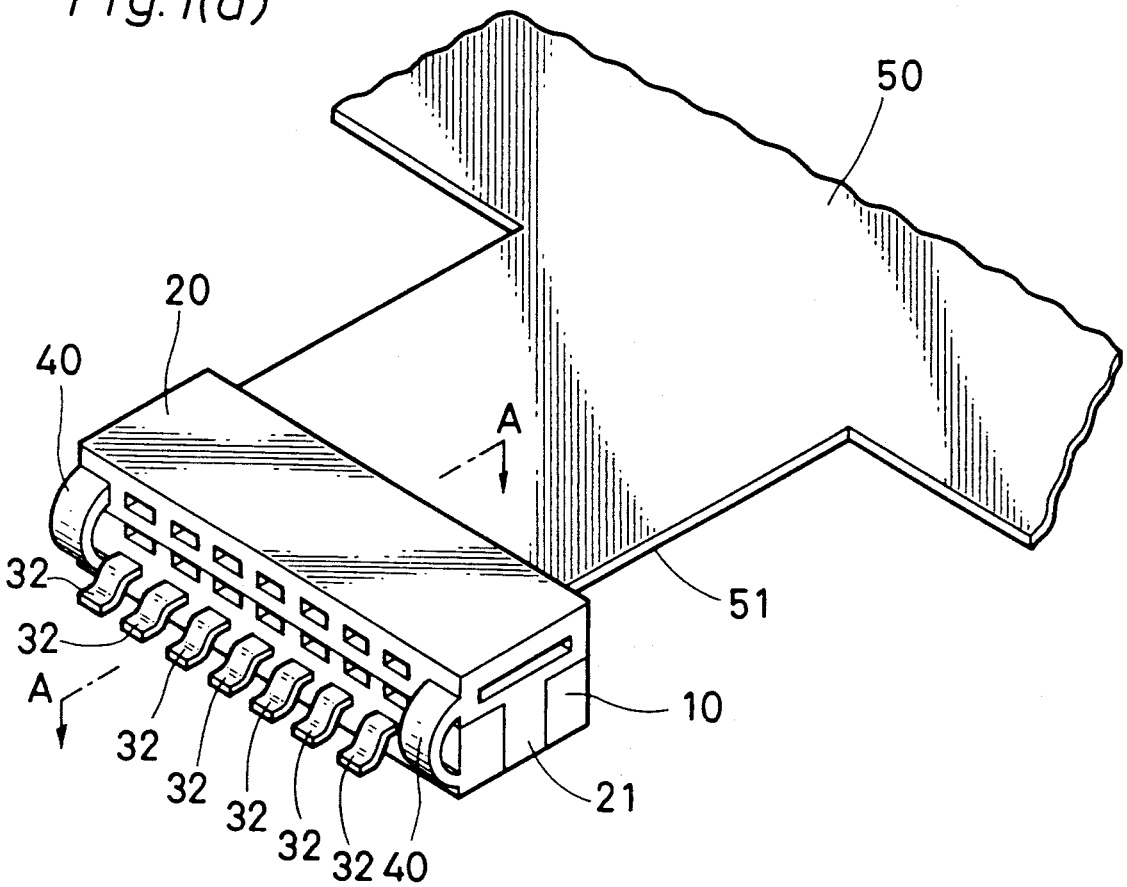
Figure 2:
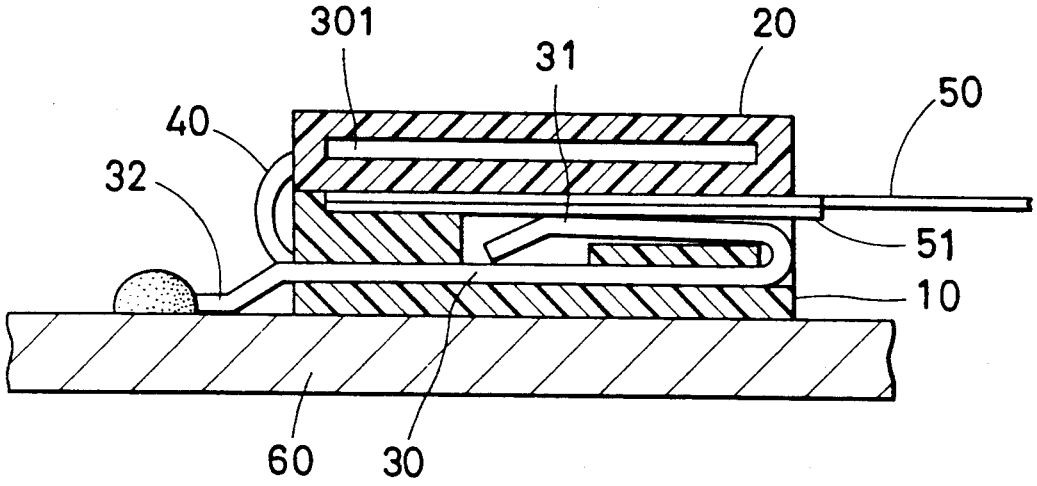
FIG. 2 shows a sectional view taken along the line A—A in FIG. 1 (*d*).

For convenience of making the present invention readily understandable, a description of FIG. 1 which explains the process of manufacturing the connector of the invention will be noted in the begining. The numeral 10 indicates a body. 20 indicates a cover. 30 indicates a contact line in general. First, a contact frame including two opposite side carriers 301 and a plurality of contact lines 30 arranged in parallel with a slit space between each other and bridging the two carriers 301 is prepared as a prior stage component (see the left half of FIG. 1 (*a*)). This prior component is subjected as an insert to the insert molding with use of a suitable plastic, known in the pertinent art, to configure the body 10 and the cover 20 connected with a pair of hinges 40 as shown in the right half of FIG. 1 (*a*). Thereby the contact lines 30, seven contact lines as shown in the drawings are partly covered or included into the plastic body 10, and lines 31, 32 are now extended from two opposite sides of the body 10. One of the two carriers 301, a near one as shown FIG. 1 (*a*), is likewise included into the newly configured cover 20. These two parts 10, 20 are interconnected by a pair of hinges 40 which are disposed outside the lines 32.

Then, the contact lines 31, 32 and one of the carriers 301 are cut at four positions as shown along four one-dot, one-dash lines 30*a*, 30*b*, 30*c*, 30*d*, wherein the line 30*b* does not extend over the paired hinges 40 located two opposite sides. That is, the hinges 40 should not be cut.

FIG. 1 (*b*) shows a first stage of the product cut out by the preceding step. The contact lines thus formed 32 are each bent like a tongue to form a extension terminal, which will be noted the terminal 32. The contact lines 31 which have been cut and formed at the opposite end are each provided with a length and then bent nearly 180 degrees in a direction indicated by an arrow mark A and folded over grooves 12 which have been formed on the body 10 during the insert molding noted above so as to receive the folded lines 31.

Thus, as shown in FIG. 1 (*c*), seven contacts 31 are aligned with each forming a leaf spring on each groove 12. Then, the intermediate stage product shown in FIG. 1 (*c*) is bent about the two hinge portions 40 as a pivotal center according to an arrow mark B so that the cover portion 20 comes to fit on the body 10 as shown by FIG. 1 (*d*).

The cover 20 and the body 10 will be clamped by engaging acts of formfitting clamping devices 21, 11 mounted on two sides of the two fitting parts 20, 10. As will be apparent later, the fitting cover 20 and body 10 are first withheld with a gap G inbetween so that a flexible sheet 50 may be brought into the assembly. FIG. 1 (*d*) shows a state that the sheet 50 is being entered into the gap which remains before the engagements noted above take place. Thereby, internally of a connector formed by fitting the cover 20 to the body 10, connections of terminals of the flexible sheet 50 with the leaf spring contacts 31 are accomplished.

So far the concept of how to manufacture an embodiment of the inventive connector has been described. Additional descriptions of individual parts or steps will now be noted to supplement the descriptions so far. The contact lines 30 and the carrier 301, in short, the frame as a whole, are made of an electrically conductive metal material.

The body 10 and the cover 20 are normally molded of an insulative, plastic material. As shown in FIG. 1, on each lateral side of the body 10, a device 11 for clamping is formed. Correspondingly, on each lateral side of the cover 20, a nail 21 for engaging the device 11 is formed. The grooves 12 are formed in the same number and direction of the parallel contact lines 30, 31. As the result of the insert molding, a portion of the carrier 301 and portions of the contact lines 30 are covered with a plastic material to configure the body 10 and the cover 20 as noted above. The inclusion of the contact lines into the molded connector acts as reinforcement to the plastic material and also as stabilization of dimensions of the molded connector Therefore, the hinge portions 40 should not include any reinforcing material, because this portion 40 is put into service in bent state.

Figure 3A:
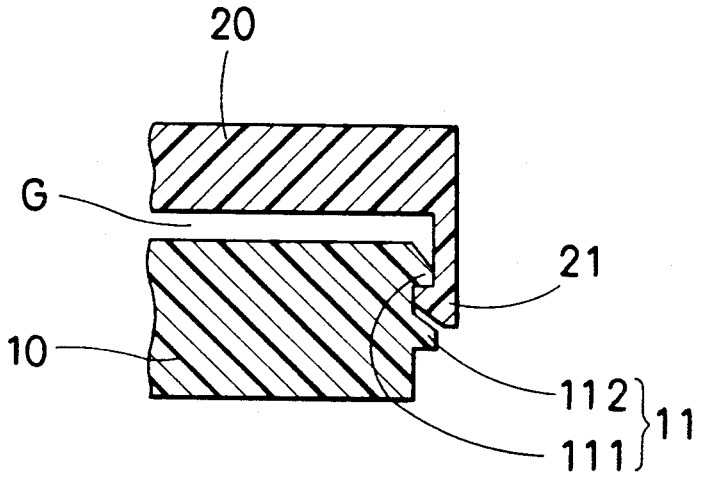
FIG. 3 including two sub-drawings FIG. 3 (*a*) to (*b*) shows sectional views of clamping acts between the body and the cover.
Figure 3B:
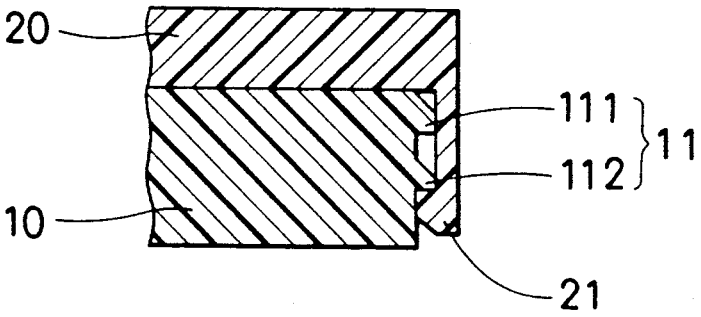
Figure 4A:
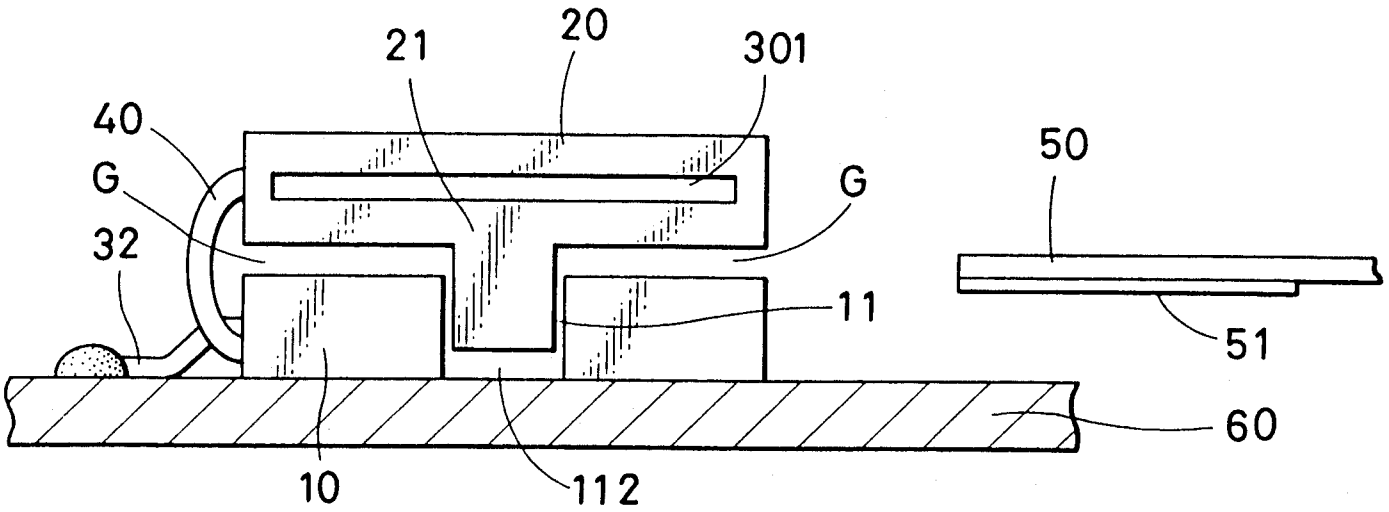
FIG. 4 including two sub-drawings FIG. 4 (*a*) to (*b*) forms views helpful to know how the flexible sheet enters into a combination of the body and the cover.
Figure 4B:
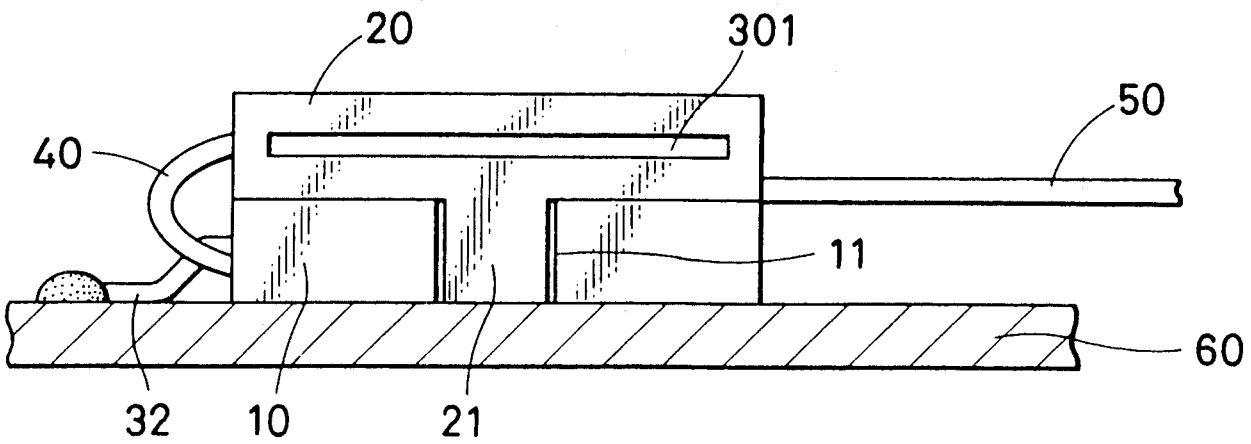

Referring to the clamping device provided with the body 10 and the cover 20 with reference to FIG. 3 including sub-drawings (*a*) and (*b*) and FIG. 4 including sub-drawings (*a*) and (*b*), a nail 21 formed on the cover 20 is designed to hook or to engage with the detent 11 as shown in FIG. 3 (*a*) and (*b*), when the cover 20 is bent over the body 10. As the FIG. 3 (*a*) shows, the hooking is first caused to take place at an intermediate stage, with the aid of an upper detent 111. At this stage, a gap G remains with a clearance which will receive a flexible sheet, a flat cable or the like that bears terminals to be connected by the inventive connector. As FIG. 4 (*a*) shows, a flat sheet 50 having a terminal surface 51 is to be entered into the gap G with the terminal surface 51 underside. After the sheet 50 has been entered in place, the cover 20 is pressed downward to advance the nail 21 to hook with the detent 112, which act closes the gap G almost completely to fix the inserted sheet firmly as shown in FIG. 3 (*b*) and FIG. 4 (*b*), thereby intended internal line contacts are accomplished.

What is claimed is:

1. An electrical connector for flat arranged terminals comprising:

a body and a cover connected together with a pair of hinges, said body, cover and hinges comprising an integral unit formed of an electrically insulating plastic material;

the body containing a plurality of flat contact lines embedded therein, said flat contact lines being made of an electrically conductive material and extending out from each of two opposite sides of said body; first extending contact lines from one side of said body being bent with each contact line forming a leaf spring contacting an upper surface of the body and second extending contact lines from another side of said body forming extension terminals; and clamping means for hooking the cover to the body to provide a clearance into which a sheet having flat arranged terminals is entered.

2. An electrical connector as defined in claim 1, wherein the clamping means provides two hooking positions comprising: a first hooking position to provide a clearance between the body and the cover to receive a sheet comprising flat arranged terminals and a second hooking position to close the clearance to fix the sheet in pressed state, whereby each leaf spring bent of a contact line makes a contact with a flat arranged terminal on the inserted sheet.

3. An electrical connector as defined in claim 1, wherein an upper surface of the body is provided with a number of parallel grooves equivalent to the number of contact lines embedded in the body.

* * * * *